United States Patent [19]

Ruzin et al.

[11] 4,227,743

[45] Oct. 14, 1980

[54] METHOD OF THERMAL-MINE RECOVERY OF OIL AND FLUENT BITUMENS

[76] Inventors: Leonid M. Ruzin, poselok Yarega, ulitsa Kosmonavtov 5, kv. 26; Jury A. Spiridonov, ulitsa Chibjusskaya, 7, kv. 81.; Gennady S. Chuprov, prospekt Lenina, 37/10, kv. 72.; Boris A. Tjunkin, ulitsa Oplesnina, 30, kv. 33., all of Komi ASSR, Ukhta; Vladimir P. Tabakov, ulitsa Soffii Kovalevskoi, 4-a, kv. 125., Moscow, all of U.S.S.R.

[21] Appl. No.: 943,558

[22] Filed: Sep. 15, 1978

[51] Int. Cl.[2] ..... E21C 41/10

[52] U.S. Cl. ..... 299/2; 166/272

[58] Field of Search ..... 299/2; 166/272

[56] References Cited

U.S. PATENT DOCUMENTS

| | | | |
|---|---|---|---|
| 1,507,717 | 9/1924 | Rich | 299/2 |
| 1,634,235 | 6/1927 | Ranney | 299/2 |
| 1,722,679 | 7/1929 | Ranney | 299/2 |
| 3,960,213 | 6/1976 | Striegler et al. | 166/272 |
| 4,008,765 | 2/1977 | Anderson et al. | 166/272 |
| 4,085,800 | 4/1978 | Engle et al. | 166/272 X |
| 4,101,172 | 7/1978 | Rabbitts | 166/272 X |

FOREIGN PATENT DOCUMENTS

| | | | |
|---|---|---|---|
| 1004977 | 2/1978 | Canada | 166/272 |

*Primary Examiner*—Ernest R. Purser

*Attorney, Agent, or Firm*—Steinberg & Blake

[57] ABSTRACT

The method of thermal-mine recovery of oil and fluent bitumens or kerogens includes providing a system of mine workings above an oil-bearing formation and drilling from these workings and from the ground surface a series of injection wells into the oil-bearing formation. An operation gallery is provided within the oil-bearing formation, from which a system of horizontal and inclined recovery wells is drilled. Then a heat carrier is positively injected into the oil-bearing formation to heat it to a temperature whereat the oil attains the required fluidity within the formation. Then a fluid is charged into the formation to force the oil from the oil-bearing formation into the horizontal and inclined recovery wells, toward the operation gallery, from which the oil is directed to the ground surface. The improvement of the method resides in that the heat carrier is injected into the formation through the horizontal and inclined recovery wells extending substantially across the predominant direction of the highly permeable zones of the oil-bearing formation, and, following the heating of the formation to the abovesaid temperature, the injection of the heat carrier is terminated, and the fluid is charged into the injection wells having minimized association with the highly permeable zones of the oil-bearing formation, to force the oil from the oil-bearing formation through the recovery wells toward the recovery gallery.

25 Claims, 11 Drawing Figures

METHOD OF THERMAL-MINE RECOVERY OF OIL AND FLUENT BITUMENS

The invention relates to recovering oil from highly viscous oil-bearing formations, and, more particularly, it relates to a method of thermal-mine recovery of oil and fluent bitumens or kerogens.

The invention can be utilized to utmost effectiveness for recovering oil from fissured and incoherent oil-bearing strata.

The invention can be also utilized for recovering oil from exhausted oil-bearing strata.

At present, oil-bearing formations of the abovementioned kinds cannot be developed by the conventional technique of drilling boreholes and wells from the ground surface, on account of the oil yield being in such cases too small for practical purposes.

There is known a method of mining recovery of highly viscous oil from oil-bearing formations or beds, according to which oil is removed to the ground surface together with the oil-bearing shale or rock. The method includes recovery of oil by providing subterranian mine workings within the oil-bearing formation, and subsequent imploding of these workings (see, for example, the U.S. Pat. No. 3,437,378; Cl. 299-2, filed Feb. 02, 1967, dated Apr. 08, 1969).

This known method, however, is labour-consuming and costly.

Besides, it involves definite hazards connected with the subsequent imploding of the mine workings.

In addition to that, the method affects the working environment and safety of the personnel, because when oil is removed together with the rock or shale containing it, as the mine workings are being excavated, gases and oil issue from the oil-bearing formation into these workings; furthermore, when oil is recovered from an incoherent oil-bearing bed, spontaneous caving-in of the workings might occur.

There is further known a mining method of recovering oil from oil-bearing beds, according to which mine workings are provided in impermeable rock underlying the oil-bearing formation, and series of wells are drilled therefrom. Then high-velocity whirling jets of liquid are directed through these wells into the oil-bearing bed, to form a slurry which is withdrawn from the bed (see the U.S. Pat. No. 3,934,935; Cl. 299-2, dated Jan. 27, 1976).

However, this method, too, is excessively labour-consuming and costly. Furthermore, it is significantly complicated in its implementation, on account of the great quantities of sand washed away with the oil from the oil-bearing bed.

There is known still another method of mining recovery of oil from an oil-bearing bed, without removing the rock or shale containing oil to the ground surface (see article by V.P. Tabakov "On Influence of Well Network Density upon Oil Yield, as Illustrated by Yarega Field Experience"/in Russian/, in Scientific-Engineering Manual on Oil Production, No. 41, VNIINeft, "NEDRA" Publishers, Moscow, 1971, p. 155).

The method includes providing a system of mine workings above the oil-bearing bed. The mining field is divided into a plurality of levels. Longitudinal field drifts are provided intermediate the levels, and drilling chambers are made therein. From these drilling chambers inclined and vertical wells are drilled into the oil-bearing bed, down to the bottom of the bed. The wells are uniformly spaced throughout the oil-bearing bed.

The spacing of the well faces, the number of the wells and the pattern of the mine workings may vary as this method is implemented, depending on the properties of the oil-bearing bed, its thickness and physical-chemical properties of the oil.

The structure of the wells requires their provision with casing columns, the voids between the casing pipes and the well wall at the well mouth being sealed with a cementing composition. The well faces remain open. A lift pipe string is lowered into the casing column, and ditches are made at the well mouths along the mine workings with an appropriate sloping angle for exposed free gravity flow of oil from the wells toward collection tanks.

At the initial stage of the operation of the wells oil, as a rule, gushes therefrom, and when the gushing dies away, air is pumped into the space between the casing and the lift pipes.

To provide for better gravity flow of oil, water is supplied into the ditches of the mine workings. Oil collected in the tanks is separated from water, heated up and pumped to the ground surface.

However, experience shows that when the last-described method is implemented in oil-bearing beds with highly viscous oil, the yield is too low.

Furthermore, the implementation of this method involves a great volume of mining work and drilling a great amount of wells uniformly spaced throughout the oil-bearing formation.

The above-mentioned method requires higher costs for lifting oil after its gushing is stopped.

Besides, the great number of operating wells uniformly spaced throughout the oil-bearing formation complicates the monitoring of the performance of individual wells, their maintenance and repairs.

The abovediscussed difficulties have brought about the need for developing oil recovery methods based on exerting physical-chemical action on the oil-bearing bed itself, and on the fluid saturating this bed.

There is further known a thermal-mine method of oil recovery by exerting steam and heat action upon an oil-bearing bed (see article by L.M. Rusin "Experience in Pumping Steam into Fissured-Porous Bed of Yarega Field"/in Russian/, in the already mentioned Scientific-Engineering Manual on Oil Production, No. 41, VNIINeft, "NEDRA" Publishers, Moscow, 1971, p. 109).

The method includes providing a system of mine workings above an oil-bearing bed.

Vertical and inclined wells are drilled from these mine workings. Pipelines are constructed in these above-bed mine workings for the heat-carrier supply, and some of the wells are connected thereto. These wells are operated as injection ones, through which the heat carrier, e.g. steam is injected or charged into the oil-bearing bed to heat the bed and to force oil into the rest of the wells, operated as recovery ones. The injection and recovery wells are alternated and spaced uniformly throughout the oil-bearing formation. The mouths of the recovery wells are open, for free gravity flow of oil down the inclined ditches of the mine workings toward collecting tanks. The mouths of both injection and recovery wells are provided with gate means.

At the initial period of the operation, with the oil-bearing bed being heated up with the heat-carrier, oil gushes from the wells, and when the gushing dies away, air is pumped into the space between the casing and the lift pipes to recover oil through the wells.

However, this known method requires the drilling of a great amount of wells, since a single well is insufficient either to heat up the oil-bearing bed or to recover oil therefrom, particularly, if the bed is relatively thin.

Furthermore, the method involves additional costs connected with supplying compressed air to lift oil through the wells.

Moreover, with the same mine workings housing both heat-carrier injection wells and oil recovery wells, the temperature and gas-content conditions of the whole atmosphere in the mine are affected; the working environment and safety of the personnel are impaired.

Besides, there is an eventuality of the heat-carrier finding its way and bursting into the open recovery wells. Such breakthrough of the heat-carrier into ventilated mine workings significantly steps up the consumption of the heat carrier per one weight unit of recovered oil.

Breaks in the operation of the recovery and injection wells result in sand plugs forming therein, and lead to a considerable amount of downtime of the wells for maintenance and repair work, which affects the per day rate of the oil yield of the oil-bearing formation.

There is also known a thermal-mine method of oil recovery, wherein a system of mine workings is provided above the oil-bearing bed, inclined at an angle from 1° to 3° to a horizontal plane (see, for example, the SU Inventor's Certificate No. 446,631).

From these mine workings injection wells are drilled for charging the heat-carrier and its uniform propagation through the oil-bearing bed. A slope and a man way are provided into the lower part of the oil-bearing bed, and a recovery gallery is provided in this part of the bed.

From the recovery gallery a system of horizontal and inclined oil recovery wells is drilled. The heat-carrier is charged into the said injection wells for its uniform propagation throughout the oil-bearing bed and for forcing oil into the said horizontal and inclined recovery wells, toward the said recovery gallery from which oil is withdrawn to the ground surface.

However, the implementation of this method involves the drilling of a great number of injection wells, to provide for uniform distribution of the heat-carrier through the oil-bearing bed, since a single heat-carrier injection well is by far insufficient for taking care of the whole oil-bearing bed, particularly when the latter is relatively thin.

Furthermore, with a smaller number of injection wells the rate of heating of the oil-bearing bed is low, whereby the yield is likewise low, which considerably increases the time of developing the oil-bearing formation.

Moreover, non-homogeneity of the oil-bearing bed and the fact that in most cases the bed has fissures therein would not enable to conduct in the most efficient manner the forcing of oil by the heat-carrier into the horizontal and inclined recovery wells, toward the recovery gallery, on account of the dominating infiltration and propagation of the forcing-out fluid through these fissures and the highly permeable zones of the oil-bearing bed, which also affects the oil yield and prolongs the development of the oil-bearing formation.

Besides, the per day yield of the oil-bearing bed is affected by the fact that the heat-carrier is charged through the injection wells, while the near-face areas of the recovery wells are less heated, and it is here where the oil flow meets the strongest resistance to its progress.

In addition to that, the charging of the heat carrier into the injection wells drilled from the mine workings overlying the oil-bearing bed results in eventual breakthrough of the heat-carrier into the inclined and horizontal recovery wells and into the recovery gallery, which sharply decreases the rate of heating the oil-bearing bed, increases the consumption of the heat-carrier, affects the working environment and safety of the personnel.

Apart from that, the supply of the heat-carrier into the great number of the required injection wells drilled from the mine workings overlying the oil-bearing bed, for uniform propagation of the heat-carrier throughout the bed, steps up the cost of ventilation of the mining workings, on account of a high degree of dissipation of heat into these workings.

It is the main object of the present invention to provide a method of thermal-mine recovery of oil, which should enable to increase the per day and total yield of an oil-bearing bed and to cut down the time of its development.

It is a not less important object of the present invention to provide a method of thermal-mine recovery of oil, which should enable to reduce the cost of recovering oil from an oil-bearing bed, to reduce the number of the wells required for charging the heat-carrier and withdrawing oil, and to minimize the complications associated with preparing the oil bed for development and with recovering the oil, on account of great quantities of sand evolving from this oil-bearing bed.

It is still another object of the present invention to provide a method of thermal-mine recovery of oil, which should enable to cut down the cost of ventilation of the mine workings required for maintaining the necessary gas-content and temperature characteristics of the atmosphere in the mine, to enhance the working environment and safety of the personnel.

These and other objects are attained by the creation of the method of thermal-mine recovery of oil, including: providing a system of mine working above an oil-bearing formation or bed; drilling from these mine workings and/or from the ground surface a plurality of injection wells for charging a fluid into the oil-bearing bed; providing a slope and a man way in the area of the oil-bearing bed; providing a recovery gallery in this area of the oil-bearing bed; drilling from the recovery gallery a system of horizontal and inclined recovery wells for recovering oil; charging a heat-carrier into the oil-bearing bed for heating same to a temperature whereat oil attains sufficient fluidity within the oil-bearing bed; charging a pressurized fluid into the oil-bearing bed to force oil from the oil-bearing bed into the horizontal and inclined recovery wells toward the recovery gallery; and withdrawing oil from the recovery gallery to the ground surface, in which method, in accordance with the invention, the heat-carrier is charged into the oil-bearing bed through the horizontal and inclined recovery wells extending substantially across the dominating direction of the highly permeable zones of the oil-bearing bed, and, following the heating of the oil-bearing bed to the required temperature, the heat-carrier supply to the recovery wells is terminated, and the pressurized fluid is charged into the injection wells minimally associated with the highly permeable zones of the oil-bearing bed, to force oil from the oil-bearing bed into the horizontal and inclined recovery wells toward the recovery gallery.

The method enables to increase the yield of the oil-bearing bed and to cut down the period of its development, owing to the enhanced penetration of the heat-carrier into the oil-bearing bed and to the stepped-up rate of the heating of the oil-bearing bed through the latter's greater volume, as well as to reduce the resistance to the oil flow encountered at the near-face areas of the recovery wells and in the highly permeable zones of the oil-bearing bed, connected therewith, at the infiltration of oil therein; the method further expanding the borders of the process of forcing oil from the oil-bearing bed.

The method enables to cut down the costs of recovering oil from an oil-bearing bed, owing to the improved pattern of the layout of the recovery wells throughout the bed, extending as they do across the direction of the highly-permeable zones of the bed, and also owing to the better yield of these wells and the possibility of reducing their number, as well as the number of the mine workings which have to be provided to drill the recovery wells therefrom.

The operating costs of the well system are reduced by the lesser number of the recovery wells required, by the reduced ingress of sand from the oil-bearing bed into the recovery wells and by the minimized eventuality of sand plugs forming therein and involving additional efforts of eliminating these plugs.

The method further enables to cut down the cost of ventilating the mine workings, in order to maintain therein acceptable atmospheric conditions, and to enhance the working environment and safety of the personnel, owing to the reduced number of ventilated mine workings.

It is expedient that the recovery gallery should be provided in the lower part of the oil-bearing bed.

This would enable to utilize in the fullest degree both the phenomenon of forcing-out the oil with the pressurized fluid, and the phenomenon of gravity flow of oil into the recovery wells.

Alternatively, when oil is recovered from an incoherent oil-bearing formation, particularly, one decreasing its stability upon being heated, it may be preferable that the recovery gallery should be provided below the oil-bearing bed, so that it should be separated from the bed by a low-permeability stable interbed of rock.

This would enable, when recovering oil from an incoherent oil-bearing bed, to reduce the cost of providing mine workings, by making them in rock more suitable for the purpose, and also to reduce the undesirable propagation of heat from the oil-bearing bed into the mine workings.

It is also expedient that the heat-carrier should be charged into the oil-bearing bed through the horizontal and inclined recovery wells to heat the oil-bearing bed until the latter is heated up to a temperature above which the viscosity of the oil at further heating is reduced but insignificantly.

This would enable to reduce the consumption of the heat-carrier by the oil recovery process and to enhance the quality of the atmosphere in the mine.

It is further expedient, if the injection wells penetrate the highly permeable zones of the oil-bearing bed, prior to charging the fluid into the injection wells, to fill the highly-permeable zones of the oil-bearing bed communicating with these wells with a plugging composition retaining oil-permeability of the porous body of the oil-bearing bed.

This enables to enhance the homogeneity of the oil-bearing bed, to conduct the forcing-out of oil by the fluid in an efficient way and to increase the yield of the oil-bearing bed.

It may be also expedient, if one and the same recovery gallery has some of the recovery wells penetrating the highly permeable zones of the oil-bearing bed and other recovery wells not communicating with these highly permeable zones, to perform, simultaneously with the charging of the heat-carrier into the oil-bearing bed through the horizontal and inclined recovery wells extending substantially across the dominating direction of the highly permeable zones of the oil-bearing bed, recovering of oil through those of the horizontal and inclined recovery wells which have the minimum communication with the highly permeable zones of the oil-bearing bed.

This enables to recover oil simultaneously with the heating of the oil-bearing bed and to accelerate the heating of the oil-heating bed itself with partial heating and creating improved conditions for the propagation of the heat-carrier into the porosity space of the oil-bearing bed.

It is further expedient that at a later stage of the oil recovery from the oil-bearing bed the recovery gallery should be periodically filled with a fluid of a density in excess of that of the oil.

This enables to increase the total yield of the oilbearing bed, by creating a non-stationary duty of the performance of the bed, the variation of the direction of infiltration flows in the bed and its better capillary impregnation.

Furthermore, it enables to reduce the degree of breakthrough of the heat-carrier into the recovery gallery, and thus to improve the working environment and to reduce the ventilation costs.

It is expedient, in the case of an incoherent oil-bearing bed, with the recovery gallery having been provided under the bed, prior to the charging of the fluid into this incoherent oil-bearing bed, to wash out with a liquid through the injection wells an area in the lower part of the bed, and then to supply into this area materials forming a stable strong structure permeable for the oil, and to drill ascending recovery wells into this area.

This enables to bring down the cost of drilling ascending recovery wells in an incoherent oil-bearing bed which is unstable during the heating and under the action of a flushing liquid, to reduce the ingress of big quantities of sand into the ascending recovery wells and into the recovery gallery, and to operate these wells efficiently and without undue complications.

It is likewise expedient, in the case of consolidation of the lower part of the oil-bearing bed through the injection wells drilled from the ground surface, to provide the recovery gallery below this oil-bearing bed and to drill therefrom ascending recovery wells into the consolidated area of the oil-bearing bed, and also to seal the faces of the injection wells and to charge the fluid through the injection wells into the area of the oil-bearing bed, disposed above the consolidated area of the bed, so as to force oil from the oil-bearing bed into the ascending recovery wells toward the recovery gallery.

This enables to use in the most efficient way the phenomenon of forcing oil by the fluid in combination with the gravity flow of oil, to minimize the possibility of the fluid breaking through directly into the ascending recovery walls drilled from the recovery gallery underlying the oil-bearing bed and to reduce the ingress of sand into the ascending recovery wells.

It is further expedient, if the fluid infiltrates into the ascending recovery wells, to close periodically the ascending recovery wells simultaneously with the feeding of the fluid into the injection wells, and, following this closing, to withdraw oil from the area underlying the closing points.

This enables to step up the oil yield of the oil-bearing bed, on account of periodic enforced fluid recovery, creating non-stationary mode of its performance, with periodic withdrawal of oil and cleaning of the near-face areas of the ascending recovery wells, and also to control the propagation of the heat-carrier through the oil-bearing bed, for the latter to be heated evenly throughout its volume.

The invention will be further described in connection with an embodiment thereof, with reference being made to the appended drawings, wherein.

The herein disclosed method is preferably performed, as follows.

Figure 1:
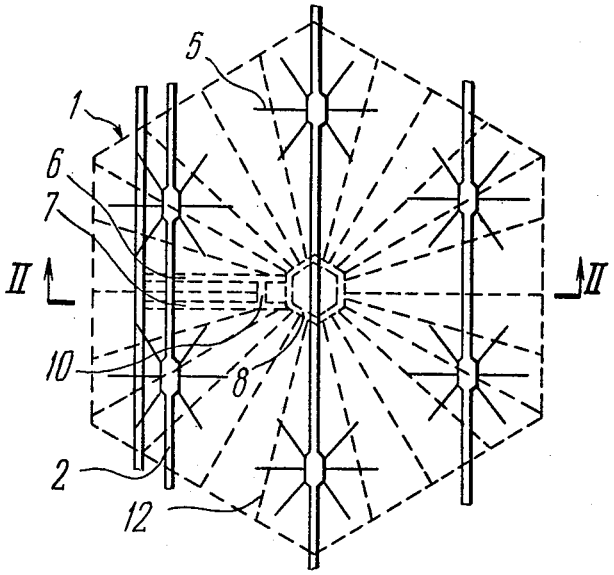
FIG. 1 is a plan view of a system of developing a single mining element or block of an oil-bearing bed, with mine workings and wells indicated.

The entire oil-bearing formation or bed is subdivided into a plurality of mining elements or blocks 1 (FIG. 1).

Figure 2:
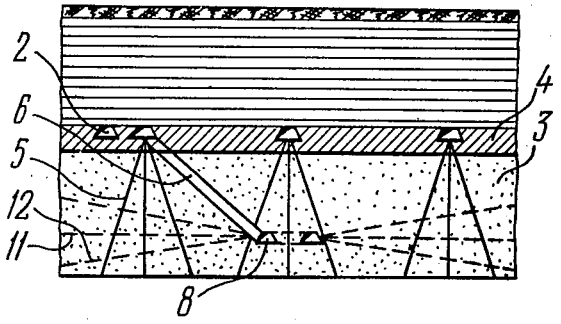
FIG. 2 is a sectional view taken on line II—II of FIG. 1.

A system of mine workings 2 is provided above the oil-bearing formation or bed 3 (FIG. 2) in low-permeability above-bed rock 4.

Then from these mine workings 2 there are drilled vertical and inclined injection wells 5 for charging a fluid into the oil-bearing bed 3. If practical, e.g. in case of shallowly extending oil-bearing beds 3, the vertical and inclined injection wells 5 are drilled from the ground surface. Then a slope 6 and a man way 7 (FIG. 1) are provided into the oil-bearing bed 3, and a recovery gallery 8 is excavated within the oil-bearing bed 3.

Figure 3:
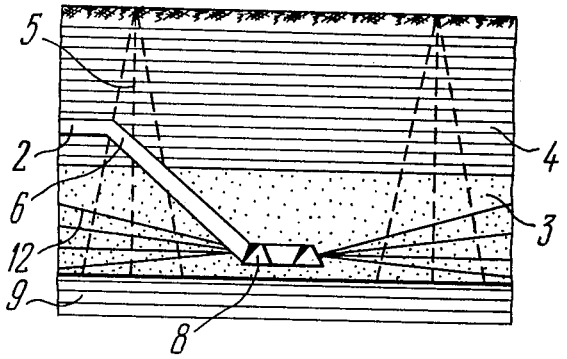
FIG. 3 is a sectional view of a single mining block of the oil-bearing bed, with mine workings and wells drilled from the mine workings within the oil-bearing bed and from the ground surface.

The slope 6 and the man way 7 (FIG. 1) are descending mine workings extending toward the area of the oil-bearing bed 3 (FIG. 2) and necessary for the provision of the recovery gallery 8. Alternatively, the slope 6 and the man way 7 (FIG. 1) may be vertical. Here and in the disclosure to follow the expression "the area of the oil-bearing bed" is used to describe the oil-bearing bed 3 per se and the under-bed rock 9 (FIG. 3) adjoining the bed.

Provided intermediate the slope 6 and the man way 7 (FIG. 1) is a pumping chamber 10 to accommodate pumps operable to raise oil to the ground surface. The recovery gallery 8 is used to drill therefrom horizontal recovery wells 11 (FIG. 2) and inclined recovery wells 12.

The term "inclined wells 12", as used here, is meant to describe both ascending and descending wells.

While providing the mine workings 2 above the oil-bearing bed, the slope 6, the man way 7 (FIG. 1) and the recovery gallery (FIG. 2), and while drilling the injection wells 5 and the recovery wells 11, 12, there is conducted a structural analysis of the geological formation of the oil-bearing bed 3, and there is determined the direction of the highly permeable zones of this oil-bearing bed; there is also investigated the relationship between these zones and the injection wells 5, and the recovery wells 11 and 12.

Figure 5:
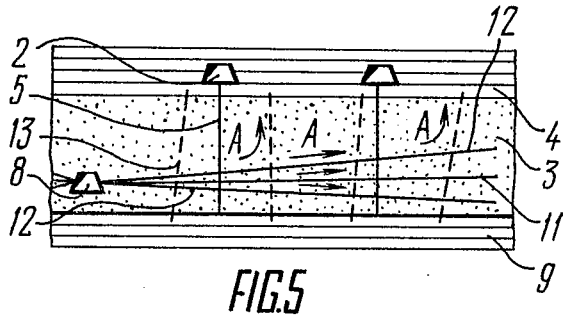
FIG. 5 is a sectional view of a single mining block of a fissured oil-bearing bed being heated.

The expression "highly permeable zones of the oil-bearing bed 3" is used here to describe oriented abnormally permeable zones in the porous body of the oil-bearing bed 3, i.e. those zones of the oil-bearing bed of which the permeability is several times that of the main body of the oil-bearing bed, as well as fissures 13 (FIG. 5).

In case of an absence in the oil-bearing bed 3 of a system of natural fissures 13, or else of abnormally permeable zones in the porous body of the oil-bearing bed 3, man-made fissures are provided therein, e.g. by conducting hydraulic fracturing of the oil-bearing bed 3, e.g. by charging through the recovery wells 11 and 12 a liquid with a breakdown agent, under a pressure in excess of the rock pressure.

Following the preparation of the oil-bearing bed for the development, a heat-carrier, e.g. steam is fed through a system of pipelines into the horizontal recovery wells 11 and inclined wells 12 extending substantially across the dominating direction of the highly permeable zones, e.g. fissures 13 of the oil-bearing bed, to heat the latter to a temperature whereat oil acquires sufficient fluidity within the oil-bearing bed 3. Instead of steam the heat-carrier may be in the form of warm or hot water, as well as of steam-water mixtures with surface-active agents or gases. Arrows "A" in the drawings indicate the direction of propagation of the heat-carrier through the oil-bearing bed.

As a result of the heat-carrier being charged into the horizontal recovery wells 11 and inclined recovery wells 12 extending across the dominating direction of the highly permeable zones, e.g. of the main pattern of the fissures 13 of the oil-bearing bed 3, the heat-carrier uniformly and swiftly propagates throughout the body of the oil-bearing bed 3. Thus, to heat up the oil-bearing bed 3, there is utilized the maximum available surface of the recovery wells 11, 12 and of the fissures 13 of the oil-bearing bed 3, which is of a particular importance at the initial stage of the development of the oil-bearing bed, when the viscous low-fluent oil opposes the access of the heat-carrier into the porous body of the oil-bearing bed, and the heat transfer to the oil-bearing bed can be effected practically exclusively owing to its heat conductivity. This enhances the optimum impact of the action of the heat-carrier upon the oil-bearing bed 3, speeds up the heating-up of this oil-bearing bed 3 and rapidly reduces the viscosity of oil, so that the latter attains sufficient fluidity in the porous body of the oil-bearing bed 3, which cuts down the oil field development time.

The greater surface of the opening-up of the oil-bearing bed 3 by the recovery wells 11 and 12 and by the fissures 13 associated and communicating therewith enables to reduce significantly the number of the wells required for oil recovery, and thus to save the cost of drilling and operating these wells.

This also cuts down the volume of the mining work associated with the provision of the mine workings, such as the slope 6 (FIG. 1), man way 7 and recovery gallery 8 required for drilling the recovery wells 11 (FIG. 2) and 12.

The greater surface area of the opening-up of the oil-bearing bed 3 also eliminates the necessity of charging the heat-carrier into the formation under a very high pressure, which helps prevent breakthrough of the heat-carrier into the mine workings 2 overlying the oil-bearing bed, into the slope 6 (FIG. 1), man way 7 and recovery gallery 8 (FIG. 2) and its bleeding beyond the area of the portion of the oil-bearing bed 3, which is being developed; and which also improves the working environment in the mine workings and enhances safe working conditions. The consumption of the heat-carrier is reduced, too.

The heating of the oil-bearing bed 3 from the recovery wells 11 and 12 enables to bring down considerably the infiltration resistance to the flow of oil from the oil-bearing bed 3 into the fissures 13 (FIG. 5) and the recovery wells 11 and 12.

This fact, in its turn, enables to increase significantly the per day yield of the oil-bearing bed, as well as to prevent the ingress of great quantities of sand into the recovery wells 11 and 12, and thus to preclude eventual faults in the operation of these wells.

Upon the oil-bearing bed 3 having been heated up to a temperature whereat the oil acquires sufficient fluidity within the oil-bearing bed 3, the feed of the heat-carrier into the recovery wells 11 and 12 is discontinued.

Then a pressurized fluid, e.g. warm water is charged into the injection wells 5 which are minimally associated with the highly permeable zones, e.g. fissures of the oil-bearing bed 3, to force oil from this oil-bearing bed 3 into the horizontal recovery wells 11 and inclined recovery wells 12 toward the gallery 8.

Figure 7:
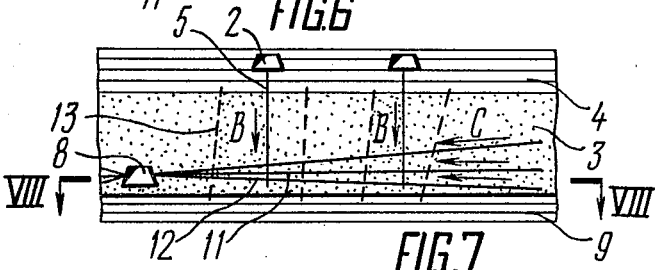
FIG. 7 is a sectional view of a single mining block of a fissured oil-bearing bed during the oil recovery stage.
Figure 8:
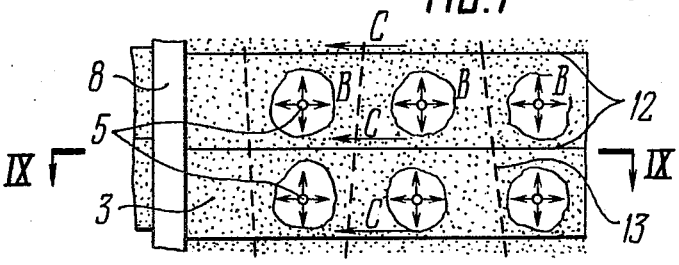
FIG. 8 is a view in plan of the section of FIG. 7 along line VIII—VIII.

The direction of propagation of the fluid through the oil-bearing bed 3 is indicated in the drawings with arrows "B" (FIGS. 7 and 8).

The direction of the flow of oil forced from the oil-bearing bed 3 is indicated in the drawings with arrows "C".

From the recovery gallery 8 oil is lifted to the ground surface by pumps installed in the pumping chamber 10 (FIG. 1).

The charging of the fluid through the injection wells 5 (FIGS. 7 and 8) minimally associated with the fissures 13 enhances the efficiency of the forcing of oil from the oil-bearing bed into the recovery wells 11 and 12 (FIG. 7) and steps up the oil yield of the oil-bearing bed 3.

This also enables to minimize the eventuality of the fluid breaking through into the recovery wells 11 and 12, as well as to reduce the amount of the fluid required for forcing oil from the oil-bearing bed 3. The conditions for the ingress of sand from the oil-bearing bed 3 into the recovery wells 11 and 12 are likewise impaired, thus eliminating eventual faults in the performance of these wells.

With oil being forced from the oil-bearing bed by the fluid into the horizontal recovery wells 11 and inclined recovery wells 12 of which the infiltration area is more heated than the rest of the zones of the formation, so that oil therein has the lowest viscosity, the oil yield of the oil-bearing bed 3 is stepped up, and the productivity of the recovery wells 11 and 12 is maintained at the maximum.

The utilization of the horizontal recovery wells 11 and inclined recovery wells 12 opening up to the maximum the highly permeable zones, e.g. fissures 13 of the oil-bearing bed for charging the heat-carrier therethrough at the bed-heating stage, and, following the heating up of the oil-bearing bed 3, for collecting therein the oil forced by the fluid charged into the injection wells 5 saves the cost of drilling extra wells and providing either extra or greater mine workings, such as the slope 6 (FIG. 1), man way 7 and recovery gallery 8; it further saves ventilation costs associated with ventilation of greater mine workings, and cuts down the time of the development of the oil-bearing bed 3 (FIG. 7).

To utilize to the fullest possible degree the phenomenon of gravity flow of oil for oil recovery into the recovery wells 11 and 12, simultaneously with the forcing of oil by the fluid into the same wells 11 and 12, in one embodiment of the present invention the slope 6 and the man way 7 (FIG. 1) are provided into the lower part of the oil-bearing bed 3 (FIG. 3), and then there is provided in this lower part of the oil-bearing bed 3 the recovery gallery 8 from which the horizontal recovery wells 11 and the inclined recovery wells 12 are drilled.

This enables to step up the productivity of the recovery wells 11 and 12 and to increase the per day yield of the oil-bearing bed 3.

In another embodiment of the invention, in the case of recovering oil from an incoherent oil-bearing bed 3 becoming unstable when heated, the slope 6 and the man way 7 (FIG. 1) are provided into low-permeability stable rock 9 underlying the oil-bearing bed 3.

Figure 4:
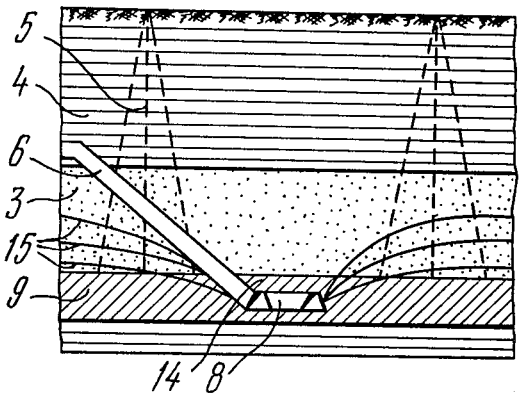
FIG. 4 is a sectional view of a single mining block of the oil-bearing bed, with the mine workings therein and wells drilled from the mine workings below the oil-bearing bed and from the ground surface.

Then the recovery gallery 8 is provided so that it is separated from the incoherent oil-bearing bed 3 by a low-permeability steady interbed 14 (FIG. 4) of the rock 9. Then ascending recovery wells 15 are drilled from this recovery gallery.

In this case the cost of the provision of the recovery gallery 8 is reduced, the undesirable propagation of heat from the oil-bearing bed 3 into this recovery gallery 8 being curbed down, and the ventilation costs being reduced, too.

In a preferred embodiment of the present invention, the heat-carrier is fed into the oil-bearing bed 3 through the recovery wells 11, 12 and 15 until the oil-bearing bed 3 is heated up to a temperature above which the viscosity of the oil is practically not reduced by further heating.

The practical experience of the inventors has proved that various crude oil grades with different compositions have each a definite temperature above which this oil grade does not become more fluid at further heating.

If the oil-bearing bed 3 is inadequately heated, i.e. if it is not heated to reduce the oil viscosity to the necessary level, the efficiency of the forcing out of oil by the pressurized fluid is affected; however, on the other hand, excessive heating of the oil-bearing bed 3 would not significantly enhance this efficiency and increase the oil yield.

The heating of the oil-bearing bed 3 to the abovementioned optimum temperature reduces the overall consumption of the heat-carrier by the oil recovery process. In this way excessive heating of the oil-bearing bed 3 is precluded, the atmosphere in the mine workings is improved, and the costs of ventilation of the mine workings 2 (FIG. 1) above the oil-bearing bed 3, of the slope 6 and of the man way 8 are reduced.

In another embodiment of the present invention, in the case of the presence in the oil-bearing bed (FIG. 5) of a dense network of natural high-permeability zones, e.g. fissures 13, the injection wells 5 drilled from the mine workings 2 and from the ground surface inadvertently penetrate or open up at least some of these fissures 13.

Therefore, prior to forcing oil by the pressurized fluid into the recovery wells 11, 12 and 15 (FIG. 4) toward the recovery gallery 8, there is charged into those of the injection wells 5 (FIG. 5), which are communicating with the fissures 13, a plugging composition selected to retain the oil-permeability of the porous body of the oil-bearing bed, e.g. a binder based on a mixture of phenols with water, a solvent and a setting agent.

Then into the same injection wells 5 there is charged a neutral liquid, e.g. crude oil, to force the plugging solution from these injection wells 5 into the fissures 13 of the oil-bearing bed 3.

And only then the pressurized fluid is charged into the injection wells 5 to force oil from the oil-bearing bed 3 into the recovery wells 11, 12 and 15 (FIG. 4), toward the recovery gallery 8.

The filling up of the fissures 13 (FIG. 5) associated with at least some of the injection wells 5 with the plugging solution enables to level out the homogeneity of the oil-bearing bed 3 as far as its oil-permeability is concerned, and to enhance the efficiency of the forcing-out of oil from this oil-bearing bed 3 by the pressurized fluid. This enables to increase the oil yield of the oil-bearing bed 3, to prevent breakthrough of the pressurized fluid via the fissures 13 into the recovery wells 11, 12 and 15, and to reduce the amount of the pressurized fluid required for forcing out oil.

Figure 6:
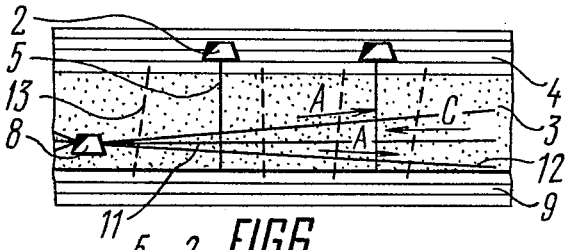
FIG. 6 is a sectional view of a single mining block of a fissured oil-bearing bed being heated, with simultaneous recovery of oil.

In another embodiment of the invention, in a case when the amount of the fissures 13 in the oil-bearing bed 3 is relatively small, and some of the recovery wells 11, 12 and 15 (FIG. 4) do not penetrate these fissures 13 (FIG. 5) of the oil-bearing bed 3, the heat-carrier is charged into the recovery wells 11, 12 and 15 extending across the direction of the main system of the fissures 13, and simultaneously oil is collected from the oil-bearing bed 3 through those of the recovery wells 11, 12 and 15 which have the minimum degree of communication or association with the fissures 13 (FIG. 6).

This enables to recover oil simultaneously with the heating of the oil-bearing bed 3, to relieve partly the porous space of the oil-bearing bed 3 from oil, thus offering this space for better propagation of the heat-carrier thereinto and to speed up the heating of the oil-bearing bed 3, owing to the greater area of the contact of the heat-carrier with the oil-bearing bed 3.

Following the heating up of the oil-bearing bed to the predetermined temperature, the feed of the heat-carrier into the recovery wells 11 and 12 is discontinued, and the pressurized fluid is charged into the injection wells 5 to force oil from the oil-bearing bed 3 into the recovery wells 11 and 12, toward the recovery gallery 8.

However, in certain practical cases, at a later stage of the oil production process the oil-bearing bed 3 becomes partly exhausted, and the productivity of the recovery wells 11 and 12 becomes insufficient.

In this case the recovery gallery 8 (FIGS. 2 and 3) provided within the oil-bearing bed 3 is preferably filled with a fluid having a density in excess of that of oil, e.g. with warm water.

Then a heat carrier under a relatively high pressure, e.g. steam is charged as the pressurized fluid into those of the injection wells 5, which have the minimum communication or association with the fissures 13.

This feed of the heat-carrier into the oil-bearing bed 3 is carried out until the latter is heated to a predetermined higher temperature.

Then the charging of the heat-carrier into the said injection wells 5 is terminated, warm water is charged thereinto as the pressurized fluid, and from the recovery gallery 8 the fluid, e.g. water is pumped by pumps installed in the pumping chamber 10 (FIG. 1) into the mine workings 2 (FIG. 2) overlying the oil-bearing bed 3 and/or to the ground surface, to charge this fluid once again into the said injection wells 5.

Following the pumping out of water from the recovery gallery 8, the operation of forcing out oil from the oil-bearing bed 3 by the pressurized fluid into the recovery wells 11 and 12 toward the recovery gallery 8 is continued as long as the productivity of these wells 11 and 12 remains at a satisfactory level.

Upon the reduction of the productivity of the recovery wells 11 and 12 below the said level, the recovery gallery 8 is once again filled with warm water, and the heat-carrier is charged into the injection wells 5.

The abovedescribed pattern of filling the recovery gallery 8 with water and pumping water therefrom is repeated periodically, as long as the oil-bearing bed 3 remains adequately heated, and the productivity of the recovery wells 11 and 12 remains at the satisfactory level.

The recurrent filling of the recovery gallery 8 with the fluid, e.g. water enables to charge the heat-carrier at a high pressure through the injection wells 5, and thus to increase the rate and to enhance the efficiency of the heating-up of the oil-bearing bed 3 and of the forcing-out of oil therefrom, while reliably sealing away the recovery wells 11 and 12 and precluding the breakthrough of the heat-carrier, e.g. condensed steam into the recovery gallery 8 and into the mine workings 2 overlying the oil-bearing bed 3, including the slope 6 and the man way 7 (FIG. 1 In this way the costs of ventilation of the said mine workings are substantially reduced, and the working environment and safety of the personnel are enhanced.

The filling up of the recovery gallery 8 (FIG. 2) extending within the oil-bearing bed 3 with the fluid, e.g. water provides for a substantial increase in the water-saturation of the oil-bearing bed 3, owing to the water inflow through the recovery wells 11 and 12 and the fissures 13 associated therewith, and for more intense capillary impregnation of the oil-bearing bed 3, while the pumping out of this fluid from the recovery gallery 8 provides for enforced recovery of liquid from the oil-bearing bed 3.

In this manner a non-stationary mode of performance of the oil-bearing bed 3 is provided for, with recurrent oscillations of the liquid flow rates and variation of the velocity and direction of the infiltration flows, which enables to involve into the development by the recovery wells 11 and 12 of low-permeability intervening portions of the bed 3, its blind portions, the least heated portions, and the like.

The abovedescribed processes increase the productivity of the recovery wells and cut down the time of the total oil production from the oil-bearing bed 3.

Figure 9:
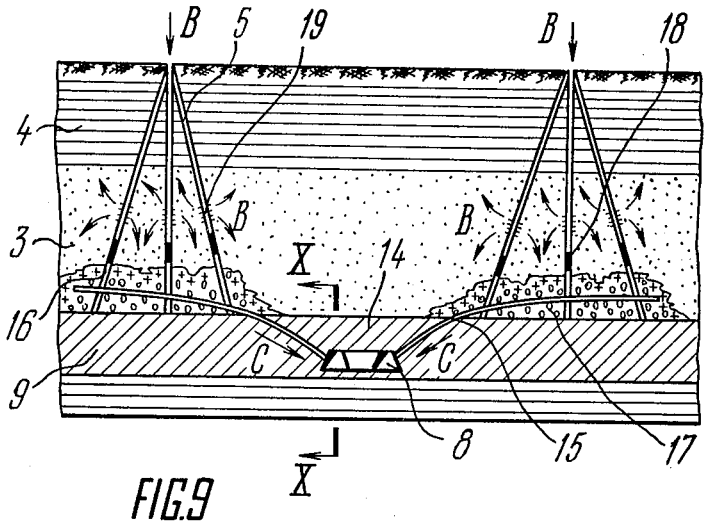
FIG. 9 is a sectional view of a single mining block of an oil-bearing bed, with the mine workings therein and wells drilled from the mine workings underlying the oil-bearing bed and from the ground surface.

In another embodiment of the present invention, when oil is to be recovered from an incoherent oil-bearing bed 3 (FIG. 9), particularly a bed that becomes unstable upon being heated, following the drilling from either the mine workings 2 or from the ground surface of the injection wells 5 into the oil-bearing bed 3 to the bottom thereof, the slope 6 and the man way 7 are excavated into the low-permeability rock formation 9 underlying the oil-bearing bed 3.

Then the recovery gallery 8 is provided under the oil-bearing bed 3 so that it is separated from the latter by a low-permeability stable interbed 14 of the rock 9.

Following this, the casings of the injection wells 5 are perforated at points 16 within the lower part of the oil-bearing bed, and through the perforations there is charged into this incoherent oil-bearing bed 3 under a hydraulic fracturing pressure, i.e. a pressure in excess of the rock pressure, a cold liquid, e.g. water containing an expanding agent, e.g. sand.

Following the hydraulic fracturing of the oil-bearing bed 3 between the injection wells 5, cold liquid is pumped through the latter to wash away an area in the lower part of the oil-bearing bed 3.

Then materials are fed into this washed-away part of the oil-bearing bed, e.g. a binding agent based on a mixture of phenols with water, a solvent and a setting agent, to form a stable strong structure 17 of adequate oil permeability.

To enhance the permeability of this consolidated area, the binding or consolidating agent is preferably supplied into the washed away area of the oil-bearing bed together with granulated materials, and, also preferably, the binding or consolidating agent is forced through into the peripheral portions of the washed away area being consolidated by charging into the injection wells 5 a liquid which is neutral with respect of this agent, e.g. oil.

Following the consolidation of this area of the incoherent oil-bearing bed 3, ascending recovery wells 15 are drilled from the recovery gallery 8 into this consolidated area 17 of the oil-bearing bed 3.

Then the heat-carrier is charged through these recovery wells 15 into the oil-bearing bed 3 until at least the bottom part of the latter is heated up to a temperature whereat oil acquires the necessary fluidity within the oil-bearing bed 3.

With this attained, the charging of the heat-carrier through the recovery wells 15 is discontinued, and the pressurized fluid, e.g. steam is charged into the oil-bearing bed 3 through the injection wells 5 to force oil into the recovery wells 15 toward the recovery gallery 8.

The consolidation of the incoherent oil-bearing bed 3 through the injection wells 5 drilled either from the ground surface or from the mine workings 2 overlying the oil-bearing bed 3, and the subsequent drilling of the recovery wells 15 into the consolidated and adequately permeable area 17 enable to preclude complications otherwise associated with the drilling of the ascending recovery wells 15 in the incoherent oil-bearing bed 3, e.g. the inflow from the bed 3 of big quantities of sand on account of the action upon this bed 3 with the drilling tools and the drill mud. Thus, the cost of drilling the ascending recovery wells 15 is reduced.

Furthermore, the conditions of creating an infiltration zones of the ascending recovery wells 15 in the incoherent oil-bearing bed 3 are significantly facilitated; the complications involved in the creation of such zones are precluded, and conditions are created for supplying into the oil-bearing bed 3 greater volumes of the required filtration materials, including granulated materials.

There is provided a possibility of creating an infiltration zone of a great area adjacent to the ascending recovery wells 15 with the use of granulated materials, which enables to improve its permeability and to enhance the productivity of the recovery wells 15.

The complications associated with the operating of the ascending recovery wells are also minimized, owing to the minimized ingress of great quantities of sand from the incoherent oil-bearing bed 3 into these wells, which also increases the productivity of these wells 15.

The utilization of a large volume of granulated material for consolidation of the infiltration zone of the ascending recovery wells 15 in the lower portion of the incoherent oil-bearing bed 3 provides for better draining coverage by the recovery wells 15 of a greater area of the oil-bearing bed 3 and steps up the productivity of the wells.

Ultimately, this enables to reduce the volume and number of the mine workings which are to be provided, i.e. of the slope 6 (FIG. 1), of the man way 7 and of the recovery gallery or galleries 8, owing to the smaller number of the recovery wells (FIG. 9) required for the development of the oil-bearing bed 3.

In still another embodiment of the present invention, to enhance the efficiency of forcing out oil by the pressurized fluid into the recovery wells 15 toward the recovery gallery 8 and to utilize to the fullest degree the phenomenon of gravity flow of oil into the recovery wells 15, prior to charging the pressurized fluid into the injection wells 5 to force out oil from the incoherent oil-bearing bed 3, the faces of the injection wells 5 are sealed, e.g. with aid of packers 18. Then perforations 19 are made through the respective casings of the injection wells 5 centrally of the oil-bearing bed 3, and the heat-carrier is charged into the injection wells 5 as the pressurized fluid, e.g. steam, to force oil into the ascending recovery wells 15 toward the recovery gallery 8.

This enables to enhance the efficiency of the utilization of the pressurized fluid, e.g. steam as both the agent for forcing out oil and as the heat-carrier for heating the oil-bearing bed, and thus to reduce the consumption of this pressurized fluid.

The sealing of the faces of the injection wells 5 with the packers 18 and the charging of the pressurized fluid into the central part of the incoherent oil-bearing bed 3 prevents breakthrough of this fluid, e.g. of condensed steam, into the ascending recovery wells 15 and into the mine workings 2 overlying the oil-bearing bed 3, the slope 6, the man way 7 and the recovery gallery 8, which improves the state of the atmosphere in the mine and reduces the ventilation costs.

The charging of the pressurized fluid into the central part of the incoherent oil-bearing bed 3 also prevents the ingress of great quantities of sand into the ascending recovery wells 15.

As the pressurized fluid, e.g. steam is charged through the injection wells 5 into the incoherent oil-bearing bed 3 to force oil therefrom into the ascending recovery wells 15 toward the recovery gallery 8, the portion of the incoherent oil-bearing bed 3 intermediate the wells 5 and 15 is under the action of the most pronounced pressure drop (or, as it is sometimes said, under the greatest depression).

Oil within this portion of the oil-bearing bed 3 is under the most pronounced action of the pressurized fluid, e.g. of steam, and is the first to be forced out into the recovery wells 15, i.e. this portion is the first to become highly permeable for the pressurized fluid, e.g. steam.

Condensed steam becomes capable of breaking through into the ascending recovery wells 15, affecting thereby the state of the mine atmosphere and doing no useful work of forcing oil from the oil-bearing bed 3. Besides, the breakthrough of the pressurized fluid directly into the recovery wells 15 sharply increases the quantity of sand carried into these wells and clogs their infiltration zone with sand.

Figure 10:
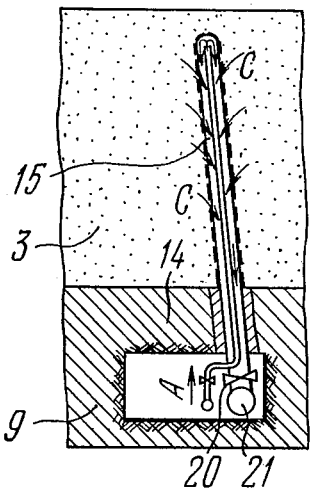
FIG. 10 is a sectional view taken on line X—X of FIG. 9 of a portion of a single mining block of an oil-bearing bed, with the mine workings underlying the oil-bearing bed and wells drilled therefrom.

In this case, according to a further embodiment of the present invention, simultaneously with the charging of the pressurized fluid into the injection wells 5, the ascending recovery wells 15 (FIG. 10) are periodically closed off, e.g. with a gate 20. Following their closing-off, oil is pumped from a zone underlying the closing-off point, i.e. from the recovery well 15 below the gate 20, and from the oil-collecting manifold 21 through the recovery gallery 8 to the ground surface.

The period between the opening and closing of the recovery well 15, during which oil is recovered from the open well 15, is set to correspond to the satisfactory productivity of the well 15 and to the tolerable content of the fluid, e.g. of condensed steam in its product.

As soon as the said parameters fail to meet the predetermined standards, the ascending recovery well 15 is closed off with the gate 20, and recovery of oil therefrom is discontinued for the preassessed period of restoration of these parameters of the preset norm, during which period oil is recovered from the adjacent open recovery wells 15.

With the abovementioned period having lapsed, the said ascending recovery well 15 is reopened, and the liquid having in the meantime accumulated in this recovery well 15 flows at a high rate into the empty oil collector 21, causing a pressure drop at the face of the well 15.

The periodic closing of the ascending recovery wells 15 enables to vary the direction of infiltration flows of the fluid in the incoherent oil-bearing bed 3 and to increase the oil yield thereof; and when the heat-carrier is charged through the injection wells 5 as the pressurized fluid for forcing out oil, there is ensured the regulation of the thermal action upon the incoherent oil-bearing bed by maintaining the uniformity of the propagation of the heat-carrier throughout the volume of the bed; moreover, the conditions for the heat-carrier breaking through into the ascending recovery wells 15 are minimized.

This decreases the value of the consumption of the heat-carrier per weight unit of recovered oil and enhances the state of the atmosphere in the mine.

The periodic closing of the ascending recovery wells 15, followed by withdrawal of oil from the zone underlying the closing spot through the recovery gallery 8 to the ground surface also enables, and that without additional cost, to periodically create depressions acting upon the oil-bearing bed and to clear the near-face areas of the ascending recovery wells 15.

This enables to step up the productivity of the recovery wells 15.

Figure 11:
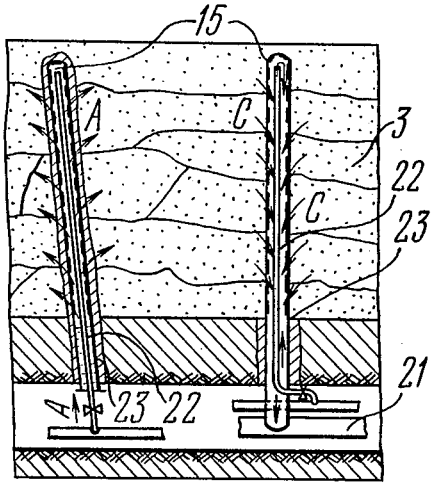
FIG. 11 is a sectional view of a portion of a single mining block, with the mine workings underlying the oil-bearing bed and wells drilled therefrom.

The charging of the heat-carrier through the ascending recovery wells 15 into the oil-bearing bed 3 at the stage of heating the latter to a temperature whereat oil acquires sufficient fluidity in the oil-bearing bed 3 is preferably effected via tubes 22 (FIG. 11) accommodated within the casings 23 of the ascending recovery wells 15.

The about-tube space intermediate the casing 23 and the tubes 22 is sealed away at the mouth of the well with a plugging solution, e.g. one containing a liquid hydrocarbon and a pulverulent mineral weighing agent, such as finely ground silica with particle size short of 1 micron.

The said solution is to have a high boiling point, to prevent evaporation thereof in the outside-tube space, as it is heated by the heat-carrier.

The solution, which can be any suitable known per se one, is to be adequately stable, proof against disintegration within a preset time, sufficiently dense and viscous at elevated temperatures, of low heat conductivity and of fine sealing properties.

The sealing away of the mouths of the ascending recovery wells 15 at the stage of the charging of the heat-carrier at an elevated temperature into the oil-bearing formation enables to prevent the breakthrough of the heat-carrier into the recovery gallery 8 and to reduce the emanation of heat into the recovery gallery 8 on account of heat conductivity. This enhances the state of the mining atmosphere and reduces the ventilation costs.

What is claimed is:

1. A method of thermal-mine recovery of oil and fluent bitumens, which comprises providing a system of mine working overlying an oilbearing formation;

drilling from said mine working and from the ground surface a plurality of injection wells adapted for charging a pressurized fluid therethrough into the oil-bearing formation; providing a slope and a man way in the area of the oil-bearing formation, where the provision of a recovery gallery is envisaged; providing the recovery gallery in this area of the oil-bearing formation;

drilling from said recovery gallery a system of horizontal and inclined oil recovery wells which are separate from the injection wells;

charging a heat carrier into the recovery wells extending substantially across the dominating direction of the highly permeable zones of the oil-bearing formation, for uniform distribution thereof throughout the volume of the oil-bearing formation and for heating the latter to a temperature at which the oil acquires sufficient fluidity within the oil-bearing formation;

terminating the charging of the heat-carrier into said recovery walls upon the oil-bearing formation having attained the said temperature;

charging a pressurized fluid into the injection wells which are separate from the recovery wells and minimally associated with the highly permeable zones of the oil-bearing formation, to thereby directly supply the pressurized fluid through the injection wells into and to force oil from the oilbearing formation into said horizontal and inclined recovery wells, toward said recovery gallery; and withdrawing oil from said recovery gallery to the ground surface.

2. A method of claim 1, wherein said recovery gallery is provided in the lower part of the oil-bearing formation.

3. A method of claim 2, wherein, the heat-carrier is charged into the oil-bearing bed through the horizontal and inclined recovery wells to heat the oil-bearing bed until the latter is heated up to a temperature above which the viscosity of the oil at further heating is reduced but insignificantly.

4. A method of claim 3, wherein, prior to charging the fluid into the injection wells, the highly permeable zones of the oil-bearing bed communicating with these walls are filled with a plugging composition retaining oil-permeability of the porous body of the oil-bearing bed.

5. A method of claim 3, wherein, simultaneously with the charging of the heat-carrier into the oil-bearing bed through the horizontal and inclined recovery wells extending substantially across the dominating direction of the highly permeable zones of the oil-bearing bed, oil is recovered through those of the horizontal and inclined recovery wells which have the minimum communication with the highly permeable zones of the oil-bearing bed.

6. A method of claim 3, wherein, at a later stage of the oil recovery from the oil-bearing bed the recovery gallery is periodically filled with a fluid of a density in excess of that of the oil bed.

7. A method of claim 1, wherein said recovery gallery is provided below the oil-bearing formation, to be separated therefrom by a low-permeability stable rock interbed.

8. A method of claim 7, wherein, the heat-carrier is charged into the oil-bearing bed through the horizontal and inclined recovery wells to heat the oil-bearing bed until the latter is heated up to a temperature above which the viscosity of the oil at further heating is reduced but insignificantly.

9. A method of claim 8, wherein prior to charging the fluid into the injection wells, the highly permeable zones of the oil-bearing bed communicating with these wells are filled with a plugging composition retaining oil-permeability of the porous body of the oil-bearing bed.

10. A method of claim 8, wherein, simultaneously with the charging of the heat-carrier into the oil-bearing bed through the horizontal and inclined recovery wells extending substantially across the dominating direction of the highly permeable zones of the oil bearing bed, oil is recovered through those of the horizontal and inclined recovery wells which have the minimum communication with the highly permeable zones of the oil-bearing bed.

11. A method of claim 8, wherein, prior to the charging of the pressurized fluid into an incoherent oil-bearing bed an area in the lower part thereof is washed out with a liquid through the injection wells, whereupon said area is supplied with materials forming a stable oil-permeable structure and ascending recovery wells are drilled into this consolidated area of the oil-bearing bed.

12. A method of claim 1, wherein the heat-carrier is charged into the oil-bearing formation through the horizontal and inclined recovery wells to heat up the oil-bearing formation until the latter is heated to a temperature above which the viscosity of the oil decreases but insignificantly at subsequent heating.

13. A method of claim 12, wherein, prior to charging the fluid into the injection wells, the highly permeable zones of the oil-bearing bed communicating with these wells are filled with a plugging composition retaining oil-permeability of the porous body of the oil bearing bed.

14. A method of claim 13, wherein simultaneously with the charging of the heat-carrier into the oil-bearing bed through the horizontal and inclined recovery wells extending substantially across the dominating direction of the highly permeable zones of the oil-bearing bed, oil is recovered through those of the horizontal and inclined recovery wells which have the minimum communication with the highly permeable zones of the oil-bearing bed.

15. A method of claim 13, wherein, at a later stage of the oil recovery from the oil-bearing bed the recovery gallery is periodically filled with a fluid of a density in excess of that of the oil.

16. A method of claim 13, wherein prior to the charging of the pressurized fluid into an incoherent oil-bearing bed an area in the lower part thereof is washed out with a liquid through the injection wells, whereupon said area is supplied with materials forming a stable oil-permeable structure and ascending recovery wells are drilled into this consolidated area of the oil-bearing bed.

17. A method of claim 1, wherein, prior to charging the pressurized fluid through the injection wells, the highly permeable zones of the oil-bearing formation comminicating with these injection wells are filled with a plugging composition retaining oil permeability of the porous body of the oil-bearing formation.

18. A method of claim 17, wherein simultaneously with the charging of the heat-carrier into the oil-bearing bed through the horizontal and inclined recovery wells extending substantially across the dominating direction of the highly permeable zones of the oil-bearing bed, oil is recovered through those of the horizontal and inclined recovery wells which have the minimum communication with the highly permeable zones of the oil-bearing bed.

19. A method of claim 18, wherein, at a later stage of the oil recovery from the oil-bearing bed the recovery gallery is periodically filled with a fluid of a density in excess of that of the oil.

20. A method of claim 18, wherein prior to the charging of the pressurized fluid into an incoherent oil-bearing bed an area in the lower part thereof is washed out with a liquid through the injection wells, whereupon said area is supplied with materials forming a stable oil-permeable structure and ascending recovery wells are drilled into this consolidated area of the oil-bearing bed.

21. A method of claim 1, wherein, simultaneously with the charging of the heat-carrier into the oil-bearing formation through the horizontal and inclined recovery wells extending substantially across the dominating direction of the highly permeable zones of the oil-bearing formation, oil is being collected through those of the horizontal and inclined recovery wells, which have minimal communication with the highly permeable zones of the oil-bearing formation.

22. A method of claim 1, wherein at a later stage of the oil recovery from the oil-bearing formation the recovery gallery is periodically filled with a fluid of a density in excess of that of the oil.

23. A method of claim 1, wherein, prior to charging the pressurized fluid into the incoherent oil-bearing formation, an area is washed away with a liquid in the lower part of this formation, into which area materials are supplied to form a stable oil-permeable structure, whereafter ascending recovery wells are drilled into this consolidated area of the oil-bearing formation.

24. A method of claim 23, wherein the faces of the injection wells are sealed, and the pressurized fluid is charged through the injection wells into the area of the oil-bearing formation, overlying the said consolidated area thereof, to force oil from the oil-bearing formation into the ascending recovery wells toward the recovery gallery.

25. A method of claim 23, wherein, simultaneously with the charging of the pressurized fluid into the injection wells, the ascending recovery wells are periodically closed, and following this closing, oil is recovered from the area underlying the closing points.

* * * * *